United States Patent [19]

Gibson

[11] Patent Number: 4,891,286

[45] Date of Patent: Jan. 2, 1990

[54] METHODS OF USING LIQUID TONER DISPERSIONS HAVING ENHANCED COLORED PARTICLE MOBILITY

[75] Inventor: George A. Gibson, Vandalia, Ohio

[73] Assignee: AM International, Inc., Chicago, Ill.

[21] Appl. No.: 274,253

[22] Filed: Nov. 21, 1988

[51] Int. Cl.[4] ..... G03G 9/18

[52] U.S. Cl. ..... 430/38; 430/115

[58] Field of Search ..... 430/117, 119, 115, 38

[56] References Cited

U.S. PATENT DOCUMENTS

| | | | |
|---|---|---|---|
| 3,079,272 | 2/1963 | Greig | 117/37 |
| 3,427,247 | 2/1969 | Peck | 252/75 |
| 3,578,593 | 5/1971 | Hulse | 252/62.1 |
| 3,681,243 | 8/1972 | Okuno et al. | 252/62.1 |
| 3,888,678 | 6/1975 | Bailey, Jr. et al. | 96/87 |
| 4,062,789 | 12/1977 | Tamai et al. | 252/62.1 |
| 4,206,064 | 6/1980 | Kiuchi et al. | 430/106 |
| 4,338,390 | 7/1982 | Lu | 430/106 |
| 4,547,449 | 10/1985 | Alexandrovich et al. | 430/115 |
| 4,631,244 | 12/1986 | Mitchell | 430/137 |
| 4,663,264 | 5/1987 | Mitchell | 430/115 |
| 4,665,011 | 5/1987 | Padszun et al. | 430/114 |
| 4,681,831 | 7/1987 | Larson et al. | 430/114 |
| 4,681,832 | 7/1987 | Tachikawa et al. | 430/115 |
| 4,707,429 | 11/1987 | Trout | 430/115 |

*Primary Examiner*—John L. Goodrow

*Attorney, Agent, or Firm*—Biebel, French & Nauman

[57] ABSTRACT

Methods of using improved liquid toner dispersions in high-speed electrophotography are disclosed wherein pigment charge homogeneity and mobility are improved by the addition of effective carrier liquid-insoluble monomeric organic acids to the toner solution. Preferred acids include benzoic, succinic, p-toluenesulfonic acid, phenylphosphonic acid, salicylic acid, and 2-nitro and 4-nitrobenzoic acid.

28 Claims, No Drawings

METHODS OF USING LIQUID TONER DISPERSIONS HAVING ENHANCED COLORED PARTICLE MOBILITY

FIELD OF THE INVENTION

The present invention pertains to Methods of Using Liquid Toner Dispersions that are adapted for use in high speed electrophotographic printing presses.

BACKGROUND OF THE INVENTION

Liquid toner dispersions for electrophotography are generally prepared by dispersing pigments or dyes, and natural or synthetic resins in a highly insulating, low dielectric constant carrier liquid. Charge control agents are added to aid in charging the pigment and dye particles to the requisite polarity for proper image formation on the desired substrate.

Images are photoelectrically formed on a photoconductive layer mounted on a conductive base. The layer is sensitized by electrical charging whereby electrical charges are uniformly distributed over the surface. The photoconductive layer is then exposed by projecting or alternatively by writing an image over the surface with a laser or L.E.D. The electrical charges on the photoconductive layer are conducted away from the areas exposed to light, with an electrostatic charge remaining in the image area. Charged pigment and/or dye particles from the liquid toner solution contact and adhere to the image areas of the plate. The image is then transferred to the desired substrate such as a carrier sheet.

In some electrophotographic processes, a photoconductive member is charged to a uniform potential and then exposed to light in a manner that forms a latent electrostatic image. This latent image is developed by immersing it in a liquid toner. A development electrode is often used to aid in this process. In the image area, the electrostatic charge is retained by the photoconductor and in the non-image areas the charge is completely or nearly completely dissipated. The development electrode is set at an electrical potential such that the toner particles will experience a relatively small force moving them away from the photoconductive member in the non-image area. One such case would be a selenium photoconductor that has received a positive charge and been exposed such that the non-image area has a potential of ca. 150 volts whereas the image area retains the majority of its initial potential which might be on the order of 1000 volts. The development electrode would then be set at ca. 200 volts so that the electric field would be in the direction of the photoconductor in the non-image area and in the opposite direction in the image area. A toner whose particles bore a net negative charge would then be attracted to the image area and slightly repelled from the non-image area.

One problem in such systems is that the toner usually contains color imparting pigment particles that bear both signs and even some that are uncharged. Among the problems that are created by this heterogeneity are that the positively charged particles will deposit in the background areas, leaving marks that are not intended. Further the uncharged particles will not respond to either electrical field although they may respond to the areas of nonuniform field by dielectrophoresis, and, as such, will be deposited in the liquid carrier creating a general fog over the entire image. The heterogeneity may also adversely affect the stability of the toner as the negatively charged particles will tend to form strong agglomerates (flocks) with the positively charged particles. When prints are made, the particles will, of course, be removed from a working liquid toner dispersion in proportion to their charge and so the liquid toner both will tend, as the printing run continues to increasingly accumulate particles that bear either the "wrong" sign, a small proportion of "correct" sign or no sign at all. This will adversely affect the performance of the developer. One readily apparent manifestation of this problem is an increasing reduction in the average net "correct" charge on the toner particles.

The above problems are particularly troublesome in high speed electrophotographic printing processes wherein successive images are rapidly formed on the photoconductive medium for rapid transfer to carrier sheets or the like traveling at speeds of greater than 100 ft./min. These high speed processes contrast to the normal office-type photocopier situation wherein, in most instances, time between successive image formation is substantially longer. Stated differently, in high speed operations, the electrophoretic velocity of the charge color imparting particles is dependent upon their charge. This reduction in electrophoretic velocity decreases the speed at which successful development can occur, thus hampering optimum high speed printing performance.

PRIOR ART

It has been suggested that benzoic acid and phenylphosphinic acid, specifically, could be used to improve the charge characteristics of liquid toners in office-type electrophotographic copiers. However, as above noted, high speed electrophotographic printing operations such as those herein specified create different and more critical problems with respect to particle velocity and particle charge accuracy over longer time periods.

Various additives have been proposed in the general field of office-copier electrophotography to increase performance of liquid toner solutions. For instance, in U.S. Pat. No. 3,681,243 (Okuno et al.) it is suggested that the developer contain at least one compound selected from the group consisting of metal-dialkyldithiophosphates, sodium alkyl-phosphates, alkyl phosphates, alkali metal-alkyl sulfates, alcohols, monocarboxylic acids having from 11 to 15 non-carboxy carbon atoms, phthalic acid, alkyl phthalates, ammonia, amines, aldehydes, decalin, azobenzene, camphor, citral, and styrene.

In U.S. Pat. No. 3,578,593 (Hulse), tricyclic diterpene carboxylic acids are used to orient and control developer particle polarity of positively charged liquid electrostatic developers. The disclosed acids are all soluble in the developer carrier liquid. Metallic salts of sundry acids are used in U.S. Pat. No. 4,681,832 (Tachikawa et al) as electric charge adjustors. Similarly, U.S. Pat. No. 4,206,064 (Kuichi et al.) discloses a metal complex of salicylic acid or a metal complex of an alkyl salicylic acid as a charge control agent in solid developers.

U.S. Pat. No. 4,062,789 (Tamai et al.) teaches the use of a variety of acids that are soluble in the developer carrier liquid in order to enhance the positive charge of the toner particles. Specifically noted are benzoic acid, succinic acid and others. (See column 3, liens 40–52). The reference is also devoid of any suggestion of use in high speed printing operations.

The use of Bronsted acids is disclosed in U.S. Pat. No. 4,665,011 (Padszun et al.) to produce or strengthen the positive charge of toner particles in electrostatographic suspension developers.

Certain quaternary ammonium salts of organic sulfonates and sulfates are used to control charge in dry electrostatic toner compositions in U.S. Pat. No. 4,338,390 (Lu). Liquid electophotographic developers using addition copolymers of a quaternary ammonium salt and a —COOH, —$SO_3H$, or $PO_3HR$ acidic function as charge control agents are disclosed in U.S. Pat. No. 4,547,449 (Alexandrovich et al.). The disclosed copolymers are soluble in the carrier liquid.

In U.S. Pat. No. 3,079,272 (Greig) solid developers are improved by use of stearic acid as a triboelectric charge control agent. Similarly, Bailey, Jr. et al U.S. Pat. No. 3,888,678 discloses charge control agents, for solid developers. Acids such as p-toluene sulfonic acid (Column 15) and p-nitrobenzoic acid, salicylic acid, succinic acid, sulfosuccinic acid, and benzoic acid, etc. may be used. (See Columns 15 and 16, Table I Run No. 4).

Of possible interest may be U.S. Pat. No. 4,707,429 (Trout) which discloses use of metallic soaps that are dispersed throughout the thermoplastic resin binder material in a liquid developer. The polyvalent metal portion of the soaps may comprise barium, calcium, magnesium, etc. with acid soap portions formed from carboxylic acids having at least 6 carbon atoms. (See column 4, lines 28–49). Larson and Trout in U.S. Pat. No. 4,681,831 discloses negatively charged resin particles in a liquid electrostatic developer wherein the resin particles are formed from a polymer containing at least one acidic constituent having a pKa less than about 4.5 and an acid number of at least one. Other patents of possible interest are 4,663,264 (Mitchell); (Larson); and 4,631,244 (Mitchell).

Despite the efforts of the prior art, there is no suggestion, as far as applicant can see therein, that carrier liquid insoluble organic acids can be used in high speed electrophotographic printing processes to enhance the mobility of negatively charged color imparting particles of a liquid toner dispersion.

SUMMARY OF THE INVENTION

The present invention addresses the problems of charge heterogeneity and particle speed in high speed electrophotographic printing processes. This is accomplished by the use of effective carrier liquid insoluble monomeric organic acids. Present experiments reveal that the incorporation of such acids into negatively charged toner dispersions decreases the number of "wrong-sign" positive charges present. Further, such treatment increases the speed in which such charged color imparting particles, e.g., pigments or dyes, are deposited on the desired electrophotoconductive substrate. Although applicant is not to be bound to any particular theory of operation, it is thought that the magnitude of improved effects that are observed are dependent upon the relative amount of acid used, the acid strength (pKa) and the particular loci upon which the acids reside on the pigment-binder particles. It is thought that charging, in liquid toners, is a surface chemistry phenomenon and accordingly, it is reasonable to believe that those acid molecules that appear at the surface of the particle will be more effective in imparting charge to the toner than those that are buried in the pigment-binder particle. (See for instance, U.S. Pat. No. 4,681,831 Larson and Trout). This factor makes it obvious that, in order to be effective, the acids must be associated with the pigment-binder particle and not exist free in the continuous liquid phase. Accordingly, I require that the acids be insoluble in the liquid carrier in order to facilitate contact with an agglomeration thereof with the pigment-binder particles.

DETAILED DESCRIPTION OF THE PREFERRED EMBODIMENT

In accordance with the invention, there is provided a liquid toner composition exhibiting increased electrophoretic mobility of the color imparting pigment or dye particles thereof and a process for using same. The invention is specifically adapted for use in high speed electrophotographic printing operations wherein images are transferred from an electroconductive plate or the like to a carrier substrate travelling at speeds in excess of 100 feet per minute or greater. The invention is directed toward the provision of increased mobility of negatively charged color imparting particles that are attracted to the positive image areas of a latent electrostatic image formed on a photoconductive member. The mobility of the color imparting particles is enhanced by the addition of an effective organic monomeric acid to the liquid toner dispersion. It is critical that the acid be insoluble in the toner carrier liquid so that the acid associates with the solid phase components of the dispersion, i.e., the color imparting particles and the resin binder.

As a carrier liquid for the liquid toner dispersions of the invention, those having an electric resistance of at least $10^9\Omega$.cm and a dielectric constant of not more than 3.5 are useful. Exemplary carrier liquids include straight-chain or branched-chain aliphatic hydrocarbons and the halogen substitution products thereof. Examples of these materials include octane, isooctane, decane, isodecane, decalin, nonane, dodecane, isododecane, etc. Such materials are sold commercially by Exxon Co. under the trademarks: Isopar®-G, Isopar®-H, Isopar®-K, Isopar®-L, Isopar®-V. These particular hydrocarbon liquids are narrow cuts of isoparaffinic hydrocarbon fractions with extremely high levels of purity. High purity paraffinic liquids such as the Norpar series of products sold by Exxon may also be used. These materials may be used singly or in combination. It is presently preferred to use Isopar®-H.

The pigments that are to be used are well known. For instance, carbon blacks such as channel black, furnace black or lamp black may be employed in the preparation of black developers. One particularly preferred carbon black is "Mogul L" available from Cabot. Organic pigments, such as Phthalocyanine Blue (C.I. No. 74 160), Phthalocyanine Green (C.I. No. 74 260 or 42 040), Sky Blue (C.I. No. 42 780), Rhodamine (C.I. No. 45 170), Malachite Green (C.I. No. 42 000), Methyl Violet (C.I. 42 535), Peacock Blue (C.I. No. 42 090), Naphthol Green B (C.I. No. 10 020), Naphthol Green Y (C.I. No. 10 006), Naphthol Yellow S (C.I. No. 10 316), Permanent Red 4R (C.I. No. 12 370), Brilliant Fast Pink (C.I. No. 15 865 or 16 105), Hansa Yellow (C.I. No. 11 725), Benzidine Yellow (C.I. No. 21 100) Lithol Red (C.I. No. 15 630), Lake Red D (C.I. No. 15 500), Brilliant Carmine 6B (C.I. No. 15 850), Permanent Red F5R (C.I. No. 12 335) and Pigment Pink 3B (C.I. No. 16 015), are also suitable. Inorganic pigments, for example Berlin Blue (C.I. No. Pigment Blue 27), are also useful. Additionally, magnetic metal oxides such as iron oxide/magnetites may be mentioned.

As is known in the art, resin or polymer binders are used in electric toners to fix the pigment particles to the charge image or, after the image has been transferred, to fix the pigment particles to the desired support medium such as paper, plastic film, etc. Useful thermoplastic resins or polymers include ethylene-vinyl acetate (EVA) copolymers (Elvax resins, DuPont), varied copolymers of ethylene and an $\alpha$, $\beta$-ethylenically unsaturated acid including (meth) acrylic acid and lower alkyl ($C_1$–$C_5$) esters thereof. Additionally, copolymers of ethylene and polystyrene, and isostatic polypropylene (crystalline) may be mentioned. Both natural and synthetic wax materials may also be used. The binders are insoluble in the carrier liquid at room temperature.

Negative charge control directors adapted to enhance or impart the desired negative charge to the color imparting pigment-resin binder solid phase components of the dispersion are known in the art and are used in accordance with the invention. Exemplary negative charge control directors include lecithin, and alkylated N-vinyl pyrrolidone polymers and the like. These charge control directors are soluble in the carrier liquid.

In addition to the (i) carrier liquid, (ii) resin binder, (iii) color imparting pigment or dye, and (iv) negative charge control director, an organic, monomeric acid that is insoluble in the carrier liquid is added to increase the electrophoretic mobility of the color imparting particles to such an extent that successful high-speed electrophotographic printing is improved. By "high-speed" electrophotographic printing, I mean, in contrast to normal "Xerox" and "Savin" office copiers, electrophotographic printing presses wherein the desired image is transferred to the carrier sheet that is traveling at speeds of from 100–1000 feet/minute and preferably from 200–400 feet/minute. In such high speed systems, in order to obtain suitable print quality, it is necessary that the colored particles exhibit high mobility so that they may be attracted to the positive image area of the electroconductive plate within the limited time available for their journey. Also, in such high speed systems, it is important that the particles, to the maximum extent possible, carry the correct negative charge so that they deposit in the image area instead of incorrect deposit in the more positive background areas of the exposure.

Accordingly, exemplary color particle mobility enhancing agents of the invention are further defined by the structural formulae:

$$R—COOH \quad (I)$$

wherein R is lower $C_1$–$C_{10}$ alkyl, lower $C_2$–$C_{10}$ alkenyl or
lower $C_2$–$C_{10}$ alkynyl; or $$HOOCR_1COOH \quad (II)$$

wherein $R_1$ is a direct bond, $C_1$–$C_6$ alkyl, $C_1$–$C_6$ alkenyl, or $C_1$–$C_6$ alkynyl, or (III)

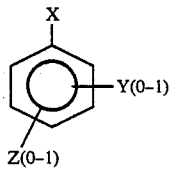

wherein X is —COOH, —P(O)$OH_2$, —$SO_3H$—, or OH; Y, when present, is OH, $NO_2$, or Cl; and Z, when present, is $NO_2$, $CH_3$, or —$SO_3H$—.

Exemplary colored particle mobility enhancing agents include

| | | |
|---|---|---|
| (I) | ethanoic acid | heptanoic acid |
| | propanoic acid | octanoic acid |
| | butanoic acid | nonanoic acid |
| | pentanoic acid | acrylic acid |
| | hexanoic acid | crotonic acid |
| | isocrotonic acid | |
| (II) | oxalic acid | maleic acid |
| | malonic acid | fumaric acid |
| | succinic acid | glutaric acid |
| | adipic acid | |
| (III) | benzoic acid | phenylphosphonic acid |
| | 2-nitrobenzoic acid | 4-nitrobenzoic acid |
| | 5-sulfosalicylic acid | p-toluenesulfonic acid |
| | salicylic acid | |

Of the above acids, a clearly preferred grouping includes benzoic acid, p-toluenesulfonic acid, phenylphosphonic acid, succinic acid, salicylic acid, 2-nitrobenzoic, and 4-nitrobenzoic acid. At present, based upon experimental results, it is most preferred to use benzoic acid.

The components of the liquid toner dispersions of the invention can be present in the following amounts: carrier liquid

| | |
|---|---|
| non-volatiles (solids) | 0.5–20 wt. % (based on total weight of carrier liquid) - preferred 2–4% |
| color imparting particles pigments or dyes | 0–50 wt. % (based on total weight solids) |
| binder (resin, polymer, or wax) | 30–99 wt. % (based on total weight solids) |
| charge control agents | $1 \times 10^{-4}$ – 20% (based on total weight of carrier liquid) |
| colored particle mobility enhancing agents | .1 –30 wt. % (based on total weight of solids) |

The organic, monomeric, carrier liquid insoluble acids are suited for use in electrophotographic printing processes wherein successive images are formed on an electroconductive material by the attraction of negatively charged pigment or dye particles dispersed in the carrier liquid of a liquid toner dispersion. The negatively charged colored particles are directed toward the positive image areas of the latent electrostatic image of the electoconductive material, such as a plate or layer, and are transferred at high speed to the desired carrier such as a paper sheet.

EXAMPLES

In order to demonstrate the efficacy of the carrier liquid-insoluble, monomeric organic acids of the present invention in enhancing the electrophoretic mobility of negatively charged toner particles, toners were prepared in accordance with the following:

Toners were prepared by blending 600 grams of Nucrel® 699 (DuPont), ethylene-vinylacetate resin, and 300 gms. of Isopar® L (Exxon) in a double planetary mixer at 90° C. until the mixture appeared homogenous.

Then, the pigment, i.e., 150 gms. of Mogul L (Cabot), carbon black was added with mixing for a period of about 2–4 hours until the mixture was homogenous. Additional carrier liquid, Isopar® L was added in 500 gms. aliquots until 1500 gms. total were added. Each aliquot was completely blended in the reaction mixture before the next one was added. After the last aliquot of carrier liquid was added, heating was discontinued and the mixture was allowed to cool to room temperature while being continuously stirred. This material was then diluted to 15% novolatile solids by the addition of more carrier liquid. Then the mixture was ground in an Attritor (Union Process) so that the solids particles had an average particle size of about 2.5 microns as determined by sedimentation. This material constitutes the base toner.

The base toner was then diluted to 10% nonvolatile solids by addition of more carrier liquid. The mixture was then tumbled in a ball mill with the desired acid treatment for a period of from 4 to 16 hours. The final "working strength" toner dispersion is prepared by addition of more carrier liquid until a final solids concentration of 2% nonvolatile solids was achieved. The resulting toner dispersion was charged by addition of 30 mg. per gram of toner solids of soy lecithin. The resulting "working strength" toner dispersions were then tested in "pulse tests" as described.

In the "pulse tests" liquid toner dispersions are added to a cell, with 1000 volt pulses being applied at timed intervals to the cell by means of a charging electrode of a given polarity. The mass of particles depositing on the collecting electrode (of opposite polarity from the charging electrode) is measured when the collecting electrode is of the charge indicated in the Table and where the pulse duration is as indicated. The + (plus) sign indicates a positive polarity collecting electrode with the amount of material depositing thereon indicating negatively charged particles. These are considered to be particles of the "correct" sign since the toner particles of the invention are negatively charged. In contrast, the − (minus) sign indicates a negative polarity collecting electrode and toner particles deposited thereon are considered to be of the "wrong" sign. Treatments which increase the amount of "correct" sign particles deposited and decrease "wrong" sign particles deposited are thought to be improved in the sense that, in the electrophotographic printing process, more particles will be attracted to the positively charged image area of the electroconductive substrate, with less particles adhering to the background portions. The fact that the requisite acids cause more correct sign particles to be attracted to the collecting electrode within a given pulse time span indicates that the "speed" or "mobility" of the particles has been enhanced compared to the control.

Results are reported in the following Table.

| sample | pulse duration polarity | | | | | | | |
|---|---|---|---|---|---|---|---|---|
| | 40 ms | | 50 ms | | 100 ms | | 200 ms | |
| treatment | (+) | (−) | (+) | (−) | (+) | (−) | (+) | (−) |
| control | 3.4 | 0.4 | 4.0 | 0.5 | 4.8 | 0.9 | 5.0 | 1.9 |
| benzoic acid | 3.5 | 0.0 | 4.0 | 0.0 | 4.8 | 0.1 | 4.9 | 0.1 |
| succinic acid | 6.0 | 0.4 | 6.0 | 0.0 | 6.8 | 0.5 | 8.2 | 0.8 |
| salicylic acid | 5.6 | 0.4 | 5.6 | 0.5 | 6.8 | 1.0 | 7.9 | 1.8 |
| 2-nitro benzoic acid | 5.2 | 0.1 | 6.0 | 0.1 | 6.5 | 0.8 | 7.9 | 1.7 |

-continued

| sample | pulse duration polarity | | | | | | | |
|---|---|---|---|---|---|---|---|---|
| | 40 ms | | 50 ms | | 100 ms | | 200 ms | |
| treatment | (+) | (−) | (+) | (−) | (+) | (−) | (+) | (−) |
| 4-nitro benzoic acid | 3.2 | 0.1 | 3.2 | 0.1 | 4.3 | 0.2 | 5.3 | 0.8 |

all acid treatments are at levels of 50 mg. acid per gram of toner solids ms = milliseconds While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. In a high speed electrophotographic printing process wherein successive images are formed on an electroconductive material by the attraction of negatively charged pigment or dye particles dispersed in a carrier liquid of a liquid toner dispersion to the image areas of the electroconductive material and wherein said images are transferred to a carrier substrate traveling at speeds of about 100 feet per minute or greater, the improvement comprising increasing the electrophoretic mobility of said negatively charged pigment or dye particles by adding to said liquid toner an effective amount for the purpose of an effective organic, monomeric acid that is insoluble in said carrier liquid.

2. Process as recited in claim 1 wherein said acid comprises a compound having the structure $$R—COOH \quad (I)$$

wherein R is lower $C_1$–$C_{10}$ alkyl, lower $C_2C_{10}$ alkenyl or lower $C_2$–$C_{10}$ alkynyl; or $$HOOCR_1COOH \quad (II)$$

wherein $R_1$ is a direct bond, $C_1$–$C_6$ alkylene, $C_1$–$C_6$ alkenylene, or $C_1$–$C_6$ alkynylene (III)

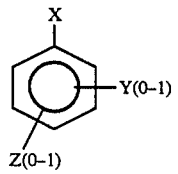

wherein X is —COOH, —P(O)$OH_2$, —$SO_3H$—, or OH; Y, when present, is OH, $NO_2$, or Cl; and Z, when present, is $NO_2$, $CH_3$, or —$SO_3H$—.

3. Process as recited in claim 2 wherein said acid comprises a compound having the structure $$R—COOH \quad (I)$$

wherein R is lower $C_1$–$C_{10}$ alkyl, lower $C_2$–$C_{10}$ alkenyl or lower $C_2$–$C_{10}$ alkynyl.

4. Process as recited in claim 2 wherein said acid comprises a compound having the structure $$HOOCR_1COOH$$

wherein $R_1$ is a direct bond, $C_1$–$C_6$ alkylene, $C_1$–$C_6$ alkenylene, or $C_1$–$C_6$ alkynylene.

5. Process as recited in claim 4 wherein said acid comprises a member selected from the group consisting of succinic acid and glutaric acid.

6. Process as recited in claim 5 wherein said acid comprises succinic acid.

7. Process as recited in claim 2 wherein said acid comprises a compound having the structure

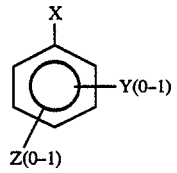

wherein X is —COOH, —P(O)$OH_2$, —$SO_3H$—, or OH; Y, when present, is OH, $NO_2$, or Cl; and Z, when present, is $NO_2$, $CH_3$, or —$SO_3H$—.

8. Process as recited in claim 7 wherein said acid comprises benzoic acid.

9. Process as recited in claim 7 wherein said acid comprises phenylphosphonic acid.

10. Process as recited in claim 7 wherein said acid comprises salicylic acid.

11. Process as recited in claim 7 wherein said acid comprises 2-nitrobenzoic acid.

12. Process as recited in claim 7 wherein said acid comprises 4-nitrobenzoic acid.

13. Process as recited in claim 7 wherein said acid comprises p-toluenesulfonic acid.

14. Process as recited in claim 7 wherein said acid comprises 5-sulfosalicylic acid.

15. In a printing process of the type wherein negatively charged color imparting particles are applied to a latent electrostatic image formed on an electroconductive substrate to form an image and wherein said image is transferred to a carrier sheet traveling at speeds of about 100 feet/minute or greater, the improvement comprising contacting said electroconductive substrate with a liquid toner dispersion comprising (i) a carrier liquid having an electrical resistance of at least $10_9\Omega$cm. and a dielectric constant of not more than 3.5;

(ii) a color imparting material selected from the group consisting of pigments and dyes;

(iii) a binder material selected from the group consisting of resin polymer binders and natural and synthetic waxes, said binder providing sites therein for attachment of said color imparting material thereto, said binder material and said color imparting material being insoluble in said carrier liquid;

(iv) a charge control agent for providing a negative charge to said color imparting particles; and (v) an organic, monomeric acid, insoluble in said carrier liquid, to enhance the electrophoretic mobility of said color imparting particles.

16. Process as recited in claim 15 wherein said acid comprises a compound having the structure

R—COOH (I)

wherein R is lower $C_1$–$C_{10}$ alkyl, lower $C_2$–$C_{10}$ alkenyl, or lower $C_2$–$C_{10}$ alkynyl; or $HOOCR_1COOH$ (II)

wherein $R_1$ is a direct bond, $C_1$–$C_6$ alkylene, $C_1$–$C_6$ alkenylene, or $C_1$–$C_6$ alkynylene (III)

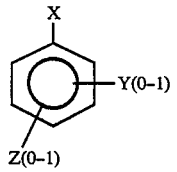

wherein X is —COOH, —P(O)$OH_2$, —$SO_3H$—, or OH; Y, when present, is OH, $NO_2$, or Cl; and Z, when present, is $NO_2$, $CH_3$, —$SO_3H$—.

17. Process as recited in claim 16 wherein said acid comprises a compound having the structure

R—COOH (I)

wherein R is lower $C_1$–$C_{10}$ alkyl, lower $C_2$–$C_{10}$ alkenyl or lower $C_2$–$C_{10}$ alkynyl.

18. Process as recited in claim 16 wherein said acid comprises a compound having the structure $HOOCR_1COOH$ wherein $R_1$ is a direct bond, $C_1$–$C_6$ alkylene, $C_1$–$C_6$ alkenylene, or $C_1$–$C_6$ alkynylene.

19. Process as recited in claim 18 wherein said acid comprises a member selected from the group consisting of succinic acid and glutaric acid.

20. Process as recited in claim 19 wherein said acid comprises succinic acid.

21. Process as recited in claim 16 wherein said acid comprises a compound having the structure

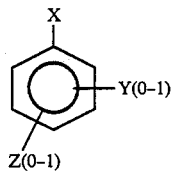

wherein X is —COOH, —P(O)$OH_2$, —$SO_3H$, or OH; Y, when present, is OH, $NO_2$, or Cl; and Z, when present, is $NO_2$, $CH_3$, or —$SO_3H$—.

22. Process as recited in claim 21 wherein said acid comprises benzoic acid.

23. Process as recited in claim 21 wherein said acid comprises phenylphosphonic acid.

24. Process as recited in claim 21 wherein said acid comprises salicylic acid.

25. Process as recited in claim 21 wherein said acid comprises 2-nitrobenzoic acid.

26. Process as recited in claim 21 wherein said acid comprises 4-nitrobenzoic acid.

27. Process as recited in claim 21 wherein said acid comprises p-toluenesulfonic acid.

28. Process as recited in claim 21 wherein said acid comprises 5-sulfosalicylic acid.

* * * * *